United States Patent [19]

Bühler

[11] Patent Number: 4,603,423

[45] Date of Patent: Jul. 29, 1986

[54] PROCESS AND DEVICE FOR THE COOLING OF FURNACES

[75] Inventor: Karl Bühler, Nussbaumen, Switzerland

[73] Assignee: BBC Brown, Boveri & Company, Limited, Baden, Switzerland

[21] Appl. No.: 599,631

[22] Filed: Apr. 12, 1984

[30] Foreign Application Priority Data

Apr. 12, 1983 [CH] Switzerland ..... 1957/83

[51] Int. Cl.[4] ..... F27D 1/12

[52] U.S. Cl. ..... 373/76

[58] Field of Search ..... 373/73, 74, 76, 77; 55/386

[56] References Cited

U.S. PATENT DOCUMENTS

| | | | |
|---|---|---|---|
| 1,030,792 | 6/1912 | Roberts | 373/76 |
| 1,035,050 | 8/1912 | Rennie | 373/76 |
| 3,612,501 | 8/1971 | Berczynski et al. | 373/76 |
| 4,274,967 | 6/1981 | Snyder | 55/386 |
| 4,470,832 | 9/1984 | Sugawara et al. | 55/386 |

FOREIGN PATENT DOCUMENTS

| | | | |
|---|---|---|---|
| 0958493 | 5/1974 | United Kingdom | 373/76 |

*Primary Examiner*—A. D. Pellinen
*Assistant Examiner*—Gregory D. Thompson
*Attorney, Agent, or Firm*—Oblon, Fisher, Spivak, McClelland & Maier

[57] ABSTRACT

To counteract the danger of the penetration of coolant in the use of a liquid-cooled device for cooling of vessel walls (27) for arc furnaces (1) and the serious consequences resulting therefrom, a pressure is created in the coolant in the thermally highly burdened cooling elements (36) which is lower than that of the ambient atmospheric pressure.

7 Claims, 4 Drawing Figures

PROCESS AND DEVICE FOR THE COOLING OF FURNACES

FIELD OF THE INVENTION

The invention relates to a process for cooling of vessel walls and covers for furnaces, especially arc furnaces, by means of a liquid-cooled device consisting of at least one cooling element.

BACKGROUND OF THE INVENTION

The increase in efficiency and cost reduction in electric steel production in arc furnaces are significantly limited by the life of the refractory lining.

To increase the life of the refractory lining for the furnace vessel and the furnace cover, basically two approaches are possible. The traditional refractory construction materials are completely dispensed with and replaced by water-cooled linings.

In the publication of the firm of Mannesmann; Demag "Water-carrying Lining of Electric Arc Melting Furnaces," undated, an arc furnace is described that is equipped with such a water-cooled vessel wall.

Water-cooled elements (pipes or boxes) are embedded in the ceramic refractory construction materials of the walls of the furnace vessel. As a result, on the one hand, a mechanical and, on the other hand, a thermal stabilization of the refractory construction materials is achieved. Such a furnace is the object of the Swiss patent application No. 552/83-3 of 1/29/83.

Both variants greatly increase the stability of the furnace vessel walls against thermal effects and thus contribute to more economical steel production, but they simultaneously involve the danger that leakages can occur in the water-cooling system unnoticed by the furnace service crew. These leakages permit free access of water or steam into the interior of the furnace chamber and may trigger oxyhydrogen explosions with incalculable consequences.

Regardless of this, water destroys a hearth of an arc furnace lined, for example, with dolomite refractory construction materials. It is especially dangerous if the water in a temporarily cold furnace does not evaporate immediately, collects in the hearth lined with ceramic refractory construction materials, and comes into contact with molten metal in the subsequent melting process. Sensors to monitor the water cooling system are very expensive and merely permit indication of inadequate functioning of all parts of the cooling system.

OBJECTS OF THE INVENTION

The invention aims at developing a cooling system, especially for arc furnaces, that has a simple design and is economical to produce, with which a long life of the furnace vessel walls and of the furnace cover can be achieved and that offers complete safety against penetration of the cooling liquid into the furnace chamber.

SUMMARY OF THE INVENTION

To achieve this aim, the invention provides that a pressure is created in the coolant in the cooling element(s) that is lower than ambient atmospheric pressure.

It is an essential characteristic of the invention that the water pressure in the cooling elements, which are in the endangered zones of the furnace vessel of high heat radiation intensity, does not exceed at any point the pressure of the ambient atmosphere (about 1 bar). Thus, penetration of water or steam into the interior of the furnace vessel is avoided with absolute certainty.

Preferably, the coolant is fed from the top down, so that the hydrostatic pressure difference aids the circulation of the coolant. This has the advantage that the hydrostatic height can be used as additional pressure difference to overcome the flow resistances.

Additionally, a pressure-reducing valve is placed in front of the intake of the coolant into the cooling elements. Thus, pressure reduction in the cooling elements can be achieved by simple means.

Moreover, a suction pump of at least one cooling element is preferably placed on the discharge side. The advantage of this stucture consists especially in the fact that a great reduction of the water pressure can be attained.

Additionally, the pump is preferably both a suction pump and a pressure pump. As a result, one and the same pump, on the one hand, produces a low water pressure in the cooling elements and, on the other hand, the water discharging from the cooling elements can be pumped, for example, into a storage tank.

Since the cooled furnace vessel walls normally do not consist of a single monolithic block but of several furnace vessel wall segments, a further development of the invention provides that the liquid-cooled device be divided into several separate coolant circuits, that each coolant circuit has at least one cooling element, and that at least two coolant circuits are allocated a pressure-reducing valve. As a result, the liquid-cooled device can be flexibly adapted to the respective number of segments of the furnace vessel walls, and adequate cooling is present in each segment.

To be able to detect immediately a possibly occurring leakage in the liquid-cooled device, a gas separator has been placed for the gas of the coolant behind the cooling elements, and the gas separator is connected with a sensor to detect gases separated from the coolant per unit of time.

The pressure-reducing valve used is preferably a manually operatable diaphragm pressure-reducing valve. The advantage of this structure is to be seen especially in the fact that, during the start-up, the cooling system can be ventilated by manual control, and the low pressure system in the cooling elements can be completely filled with water—i.e. without any residue of gas bubbles.

BRIEF DESCRIPTION OF THE DRAWINGS

The invention is explained below in more detail by means of the embodiments presented in the drawings, in which.

Figure 1:
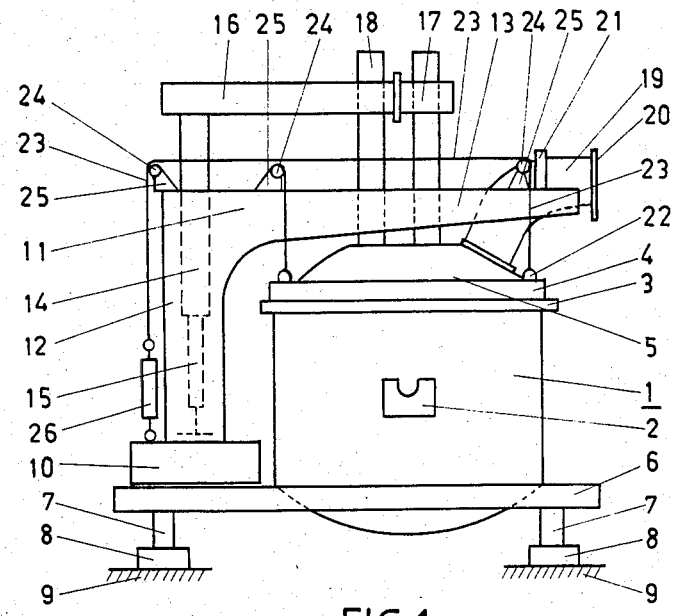
FIG. 1 is a diagrammatic representation of the front view of an example of an embodiment of an arc furnace.

Arc furnace shell 1 with furnace cover 5 is mounted in an opening on platform 6. The platform 6 which is supported by two seesawing cradles 7, which are supported on movable beams 8. The movable beams 8 in turn are firmly anchored to foundation 9. Pouring spout 2 can also be seen in FIG. 1. A movable rotary bracket 10 is placed on platform 6, and a cover lifting and swiveling device 11 is fastened to the movable rotary bracket 10. Cover lifting and swiveling device 11 consists of a bracket 13 and a bracket supporting column 12.

Platform 6 also supports three electrode adjusting columns 14, of which only one can be seen in FIG. 1. Electrode adjusting columns 14 are hydraulically individually movably connected with electrode adjusting cylinders 15. Electrode supports 16 are fastened to electrode adjusting columns 14, and electrodes 18 are held in electrode holders 17 at the outer ends of the electrode supports 16.

Of the three electrode supports 16, once again only one is completely visible in FIG. 1, and of the three electrodes 18 only two are visible and the third is hidden. Flue gas vent connection 19 with flange 20 is placed on furnace cover 5. A cover ring 4 of the furnace oven 5 rests on cover support ring 3 of the furnace shell 1. The fastening of connection 19 is not shown in FIG. 1, and its guide arrangement within bracket 13 of the cover lifting and swiveling device 11 is only vaguely indicated by guide rail 21. On cover ring 4 of furnace cover 5, carrying lugs 22 have been attached in which carrying cables 23 are fastened (two out of a total of four of the carrying cables 23 being visible in figures). Carrying cables 23 lead over rollers 24, which are mounted in pulley carriers 25 on bracket 13. Carrying cables 23 are connected to hydraulic cylinder 26 that can raise or lower furnace cover 5 from furnace shell 1.

The reference numbers in the following drawings refer to the same parts as in FIG. 1.

Figure 2:
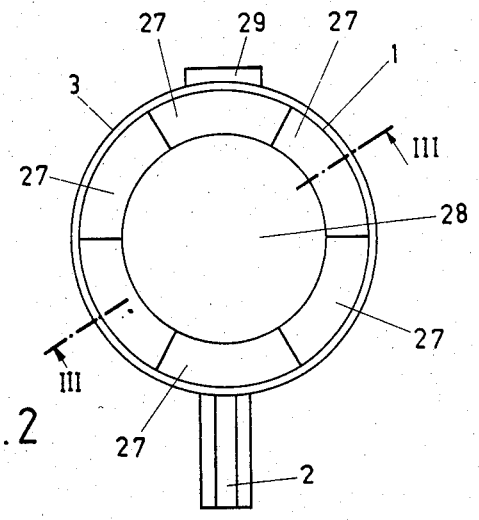
FIG. 2 is a diagrammatic top view of the furnace according to FIG. 1 but with the furnace cover removed.

FIG. 2 shows a top view of the furnace according to FIG. 1 but with the furnace cover 5 removed. Prefabricated wall elements 27, which are placed within furnace vessel shell 1, are visible. Six wall elements 27 have been attached in the embodiment according to FIG. 2 However, their number varies and depends on the size of the furnace. It has proved to be advantageous for the number of wall elements 27 to increase with growing furnace size. Furnace vessel bottom 28 and, opposite pouring spout 2, cleanout door 29 are visible in the interior of the furnace vessel.

Figure 3:
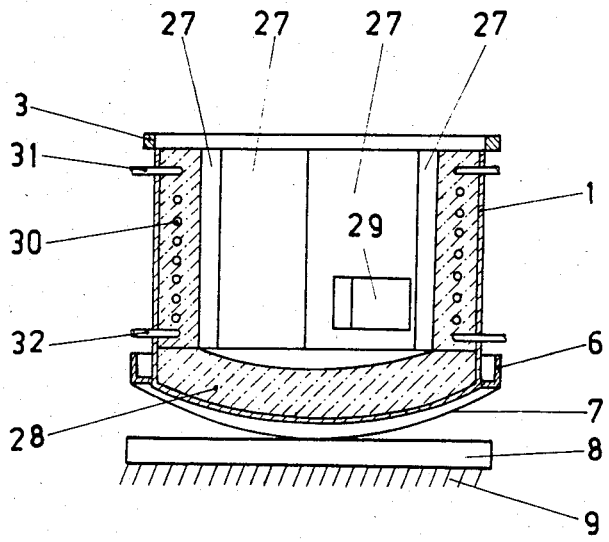
FIG. 3 is a section through the side view of the furnace according to FIG. 2.

FIG. 3 represents a section through the side view of the furnace according to FIG. 2. In sectioned wall elements 27, the water-cooling system is recognizable which in this embodiment consists of coiled, vertically running cooling pipes 30, upper feed pipe 31, and lower discharge pipe 32.

The connecting lines outside the vessel shell required for cooling system 30, 31 and 32 were omitted from FIG. 3 for reasons of greater clarity.

Figure 4:
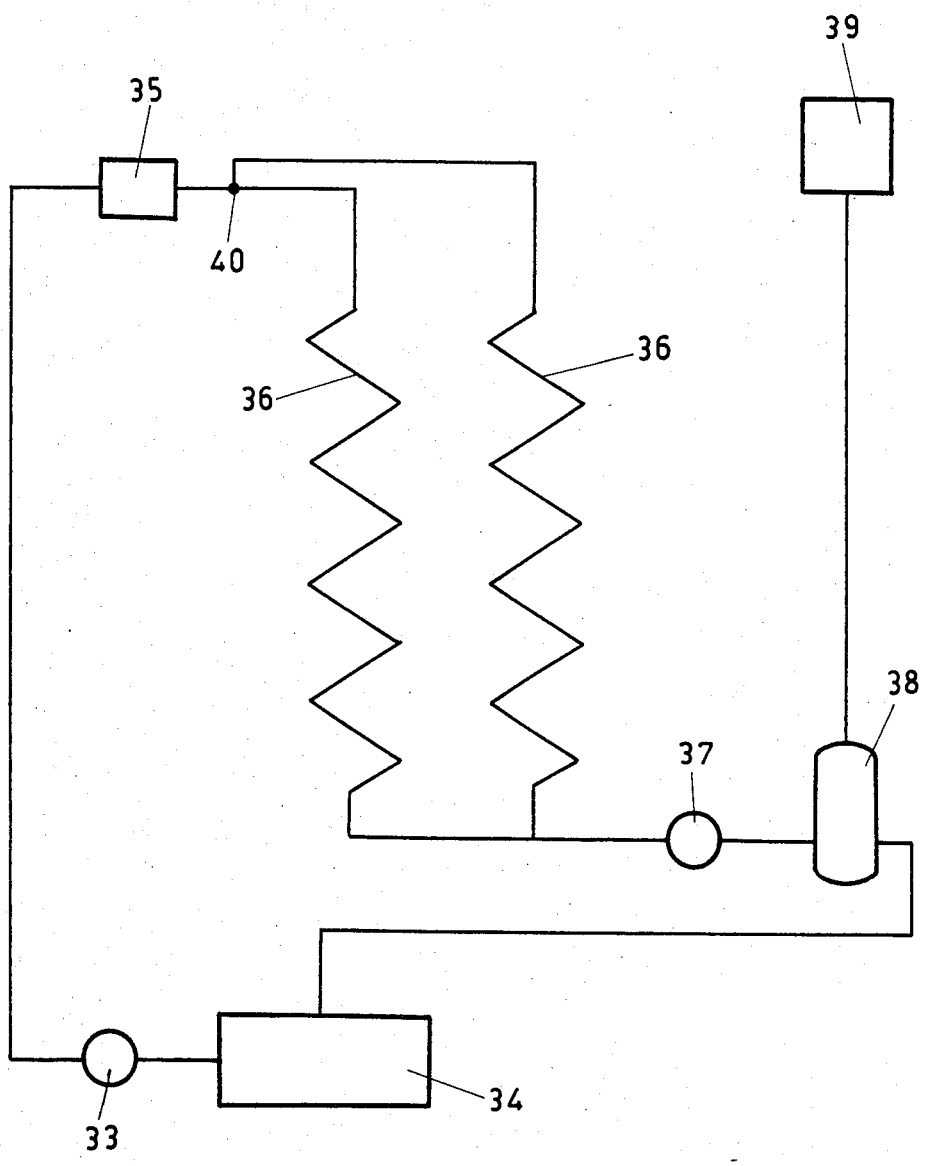
FIG. 4 is a general diagram of an example of an embodiment of the cooling system according to the invention.

FIG. 4 shows a general diagram of an embodiment of the cooling system according to the invention.

By means of FIG. 4, the functioning of the liquid-cooled device according to the invention is to be explained below in greater detail.

The coolant, preferably water, is fed from a storage tank 34 through feed pump 33 with sufficient excess pressure to a pressure-reducing valve 35. This ensures that the coolant is safely supplied depending on the static height. Pressure-reducing valve 35 reduces the existing pressure to the desired permissible peak pressure of the coolant when entering cooling elements 36. This feed pressure of the coolant is lower than ambient atmospheric pressure, for example 0.9 bar. In the embodiment according to FIG. 4, the cooling elements 36 are two coiled cooling pipes 36, with vertical axis in parallel, in the coolant circuit. However, it is feasible without any difficulty for cooling elements 36 to exhibit any other embodiment and for the cooling elements, for example, also to run horizontally. For example, it would be advantageous to use cooling boxes running in longitudinal direction in place of cooling pipes to cool the furnace cover 5. Of course, more than two cooling elements 36 can be allocated to one coolant circuit.

However, for perfect functioning of the cooling system according to the invention, it is highly desirable that the feed of the coolant takes place from a distribution point 40 into all parallel cooling elements 36 in a coolant circuit. This ensures that all parallel cooling elements 36 in the coolant circuit receive the same feed pressure.

A water pump 37 is placed on the discharge side of cooling element 36. For example, the pump 37 may be a centrifugal pump. The pump 37 sees to it that the coolant is suctioned off, and thus the low pressure in cooling elements 36 is further reduced, for example to 0.5 bar. Pump 37 according to FIG. 4 is constructed as a suction as well as pressure pump and feeds the coolant into the storage tank 34.

It goes without saying that pump 37 according to FIG. 4 could operate as a suction pump only and that, in addition to this pump, another pump can be connected that then operates as a pressure pump and feeds the coolant into storage tank 34.

By arranging the parts of the installation at different height levels—pressure-reducing valve 35 at the upper level and the pump 37 at the lower level—the result is that, taking into account the difference in pressure which, on the one hand, comes from the difference in the hydrostatic pressure (difference in height) and, on the other hand, from the hydraulic resistance of cooling elements 36, the pressure of the ambient atmosphere is at no place exceeded in cooling elements 36.

Since the cooling elements are located in the thermally highly stressed areas of the furnace vessel walls facing the interior of the furnace, care must be taken by the measures according to the invention that, in case of possible leakages of the liquid-cooled device, the coolant cannot enter the furnace chamber but that, on the contrary, gas in the furnace chamber is suctioned off into cooling elements 36.

The vertical arrangement of cooling elements 36 is a preferred embodiment of this invention. Because the coolant is fed into the upper part of cooling elements 36, the coolant successively flows downwardly and discharges from the lower part of cooling elements 36. Thus, the hydrostatic height of cooling elements 36 can be utilized as an additionally available pressure difference to overcome the flow resistances.

In FIG. 4, a gas separator 38 is attached behind pump 37.

The gas carried by the coolant is separated in gas separator 38 and is fed to a sensor 39 connected with the gas separator. The quantity of gas collected in gas separator 38 per unit of time is detected by means of sensor 39 in a manner known in the art.

By exceeding certain limits of the quantities of gas detected per unit of time, a possible leakage in cooling elements 36 can be immediately determined. This leakage is then signaled optically or acoustically in a manner known in the art, and the furnace installation is shut down.

Sensor 39 can also be directly coupled with a control unit—not shown in FIG. 4—whereby the furnace installation is automatically shut down.

The arrangement for a coolant circuit described in FIG. 4 of course is also suitable for a sizable number of separate coolant circuits, in which each coolant circuit has at least one cooling element 36 and at least one coolant circuit is allocated to a pressure-reducing valve 35.

From FIG. 2 it is evident that arc furnace 1 has six furnace vessel wall segments 27. Thus according to this embodiment, the liquid cooled device could be divided into six coolant circuits with three pressure-reducing valves 35.

But beyond that, it is also feasible that more than two coolant circuits are allocated to one and the same pressure-reducing valve 35, especially if the feeds into the coolant circuits are at approximately the same height.

In a further variant embodiment of the cooling system according to the invention, a sizable number of coolant circuits may have only a single suction pump.

Of course, means are also usable to adjust or control the water flow through the individual coolant circuits. For example, flow meters and adjusting or control valves may serve this purpose.

I claim:

1. A furnace comprising:

(a) cooling vessel walls;

(b) a cover;

(c) a liquid-cooled device disposed in one of said cooling vessel walls or said cover;

(d) first means for introducing liquid coolant into said liquid-cooled device during use of the furnace;

(e) second means for discharging the liquid coolant from said liquid-cooled device during use of the furnace; and (f) third means for insuring that, in use, the pressure of the liquid coolant in said liquid-cooled device is lower than ambient atmospheric pressure throughout said liquid-cooled device.

2. A furnace as recited in claim 1 wherein said third means comprises a pump located in said second means.

3. A furnace as recited in claim 1 wherein said third means comprises a pressure-reducing valve located in said first means.

4. A furnace as recited in claim 3 wherein:

(a) said liquid-cooled device comprises a plurality of coolant circuits;

(b) each of said plurality of coolant circuits comprises at least one cooling element; and (c) said pressure-reducing valve is in fluid communication with at least two of said plurality of coolant circuits.

5. A furnace as recited in claim 1 and further comprising:

(a) a gas separator located in said second means and (b) a sensor for the detection of gases separated from the liquid coolant by said gas separator.

6. A method of preventing the penetration of liquid coolant into the working volume of a furnace comprising:

(a) cooling vessel walls;

(b) a cover;

(c) a liquid-cooled device disposed in one of said cooling vessel walls or said cover;

(d) first means for introducing liquid coolant into said liquid-cooled device during use of the furnace; and (e) second means for discharging liquid coolant from said liquid-cooled device during use of the furnace, said method comprising the step of reducing the pressure in the liquid coolant in said liquid-cooled device to a value that is lower than ambient atmospheric pressure throughout said liquid-cooled device.

7. A process for the cooling of an arc furnace having a shell wall and wall parts, said wall parts being provided with cooling devices that are formed as pipes in thermal contact with the shell wall, thus forming a closed cooling system, said process comprising the steps of:

(a) feeding a coolant to said cooling system from above;

(b) removing the coolant at the bottom of the arc furnace; and (c) preventing the penetration of coolant from the cooling system into the interior of the vessel by producing a pressure lower than that of the atmosphere in said cooling system, whereby no coolant can penetrate into the interior of the vessel in case of damage to the cooling system.

* * * * *